US008096686B2

(12) United States Patent
Wilcox

(10) Patent No.: US 8,096,686 B2
(45) Date of Patent: Jan. 17, 2012

(54) TRIM RETENTION SPRING AND METHOD FOR RECESSED LIGHTING FIXTURES

(75) Inventor: Shawn Wilcox, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 359 days.

(21) Appl. No.: 12/427,386

(22) Filed: Apr. 21, 2009

(65) Prior Publication Data

US 2010/0265725 A1 Oct. 21, 2010

(51) Int. Cl.
*F21V 15/00* (2006.01)
*F21S 8/00* (2006.01)

(52) U.S. Cl. ..... 362/365; 362/147

(58) Field of Classification Search ..... 362/147, 362/148, 150, 364, 365, 368, 354, 376, 433, 362/440, 445; 248/906, 316.7
See application file for complete search history.

(56) References Cited

U.S. PATENT DOCUMENTS

| | | | | | |
|---|---|---|---|---|---|
| 4,539,631 | A | * | 9/1985 | Lieberman | 362/351 |
| 4,670,822 | A | | 6/1987 | Baker | |
| 4,760,510 | A | * | 7/1988 | Lahti | 362/365 |
| 4,872,097 | A | * | 10/1989 | Miller | 362/649 |
| 5,548,499 | A | * | 8/1996 | Zadeh | 362/366 |
| 5,630,663 | A | | 5/1997 | Ling et al. | |
| 5,673,997 | A | * | 10/1997 | Akiyama | 362/147 |
| 5,707,143 | A | | 1/1998 | Hentz | |
| 5,868,493 | A | | 2/1999 | Winkelhake | |
| 5,902,037 | A | * | 5/1999 | Turner et al. | 362/376 |
| 5,951,151 | A | | 9/1999 | Doubeck et al. | |
| 6,030,102 | A | * | 2/2000 | Gromotka | 362/365 |
| 6,082,878 | A | | 7/2000 | Doubek et al. | |
| 6,095,671 | A | | 8/2000 | Hutain | |
| 6,116,758 | A | * | 9/2000 | Lin | 362/364 |
| 6,164,802 | A | | 12/2000 | Gromotka | |
| 6,168,298 | B1 | | 1/2001 | Hentz et al. | |
| 6,168,299 | B1 | * | 1/2001 | Yan | 362/365 |
| 6,247,832 | B1 | * | 6/2001 | Neustadt | 362/356 |
| 6,361,193 | B1 | | 3/2002 | Gabrius et al. | |
| 6,375,338 | B1 | | 4/2002 | Cummings et al. | |
| 6,416,205 | B2 | * | 7/2002 | Uedono | 362/376 |
| 6,431,723 | B1 | | 8/2002 | Schubert et al. | |
| 6,554,457 | B1 | | 4/2003 | Platt | |
| 6,719,438 | B2 | | 4/2004 | Sevack et al. | |
| 6,899,445 | B2 | | 5/2005 | Hyder | |
| 7,217,008 | B2 | | 5/2007 | Thompson et al. | |
| 7,736,031 | B1 | * | 6/2010 | Rashidi | 362/364 |
| 2008/0158862 | A1 | | 7/2008 | Wu | |

* cited by examiner

*Primary Examiner* — David Crowe
(74) *Attorney, Agent, or Firm* — Garrett V. Davis; Mark S. Bicks; Alfred N. Goodman

(57) ABSTRACT

A lighting fixture is provided that includes a ceiling pan having an opening with a trim received therein. The trim includes a ring with a spring clip attached thereto. The spring clip includes first and second legs having a first end joined at an apex and second free end opposite the first end. The second free ends are fixed to the trim to bias the spring clip in a downward direction to engage a top surface of the ceiling pan and bias the trim in an upward direction toward the ceiling pan. In one embodiment, the ends of the spring clip are fixed to the trim by a screw. In another embodiment, the spring clip is a torsion spring engaging the trim and includes first and second legs with a portion extending therefrom and received in an aperture in the trim. The ends are oriented at an inclined angle with respect to the legs such that when the legs are attached to the trim, the legs are biased in a downward direction with respect to the ceiling pan. The torsion spring clip can be retrofit to the trim ring.

23 Claims, 12 Drawing Sheets

TRIM RETENTION SPRING AND METHOD FOR RECESSED LIGHTING FIXTURES

FIELD OF THE INVENTION

The present invention is directed to a lighting fixture having a trim retention device in the form of a spring clip. The spring clip includes first and second legs having a first end joined at an apex and second free ends fixed to a trim. The apex engages a top surface of a ceiling pan and the spring clip applies a downward force to pull the trim ring into the opening of the ceiling pan and towards the bottom surface of the ceiling pan. In one embodiment, a torsion spring clip includes first and second legs each having an extension or free end portion bent at an inclined angle to impart a downward force of the torsion spring clip to pull the trim ring toward the ceiling pan when the end portion is attached to the trim.

BACKGROUND OF THE INVENTION

Conventional methods of trim retention involve mounting a friction clip to a fixture housing, or trim, which provides an interference fit during installation. In certain situations, the friction clip is not an ideal retention method due to a number of factors. The trim may not have the correct length, angular orientation, or shape to correctly engage the friction clip. The pressure required to engage and adequately retain the trim causes dents or deformations in the trim, ruining the optical and aesthetic properties designed to be provided by the trim.

Even if the friction clip and trim engage and work properly, the installed orientation is not ideal. The friction clip and trim do not work as intended because of slight deviations in the installation such as the fixture housing not being flush with the ceiling surface, installed at an angle, or installed in a ceiling slightly thicker than the intended design of the product.

After installation, some trims have decorative or optical properties that must be aligned, oriented, or aimed for them to be aesthetically pleasing or effective. When using the friction clip method of trim retention, the trim must be repositioned by removing it from the fixture housing and replacing it while aiming properly. This process is sometimes repeated several times until the trim is properly oriented. With some friction clips, this removal and replacement process is very difficult and tends to degrade both the trim and friction clip.

Accordingly, a need exists for providing a spring retention clip that allows a light fixture trim to be easily installed while providing positive trim retention with an automatic range of adjustment. Further, a need exists for providing a spring retention clip that allows a light fixture to be easily removed without damaging the trim or the fixture housing.

SUMMARY OF THE INVENTION

Accordingly, an object of the present invention is to provide a device for installing a lighting fixture trim while providing positive trim retention with an adjustment range.

Another object of the present invention is to provide a spring having a force pulling a trim towards the ceiling surface that can compensate for fixture housing that is not installed perfectly.

A further object of the present invention is to provide a trim ring with a spring clip for allowing rotation of the trim and cross baffle after installation and avoiding reinstallation of trims.

Yet another object of the present invention is to provide a spring clip that allows a quick retrofit to existing trim rings having cross baffles.

Still a further object of the present invention is to retrofit a spring clip to an assembled riveted cross baffle with the spring clip mounted in the bore of an existing rivet using the tubular section of the rivet body as a pivot bearing.

Another object of the present invention is to provide a trim ring having a spring clip exerting a downward force such that the trim is pulled into the housing plaster frame or ceiling pan and oriented flush with the ceiling.

The foregoing objects are basically attained by providing a lighting fixture having a ceiling pan with an opening and a trim received therein. A spring clip has first and second legs joined by an apex wherein the legs are fixed to the trim ring in a manner to apply a downward spring biasing force.

The foregoing objects are also attained by providing a lighting fixture having a ceiling pan with an opening and a trim received therein. A torsion spring clip engages the trim and includes first and second legs and first and second ends each extending from first and second legs, respectively, wherein the ends are oriented at an inclined angle with respect to the legs.

The foregoing objects are also attained by providing a method of trim retention for recessed lighting fixtures including the steps of providing a ceiling having an opening; inserting a first spring clip disposed on a trim into a first side of the opening; flexing the first spring clip once installed into the opening; inserting a second spring clip disposed on a trim opposite that of the first spring clip into a second side of the opening; pushing the trim into the opening; and pulling the trim into the opening with the downward force of the first and second spring clips.

As used in this application, the terms "top", "bottom", and "side" are intended to facilitate the description of the invention, and are not intended to limit the present invention to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

Throughout the drawings, the same drawing reference numerals will be understood to refer to the same elements, features, and structures.

DETAILED DESCRIPTION OF THE INVENTION

Figure 1:
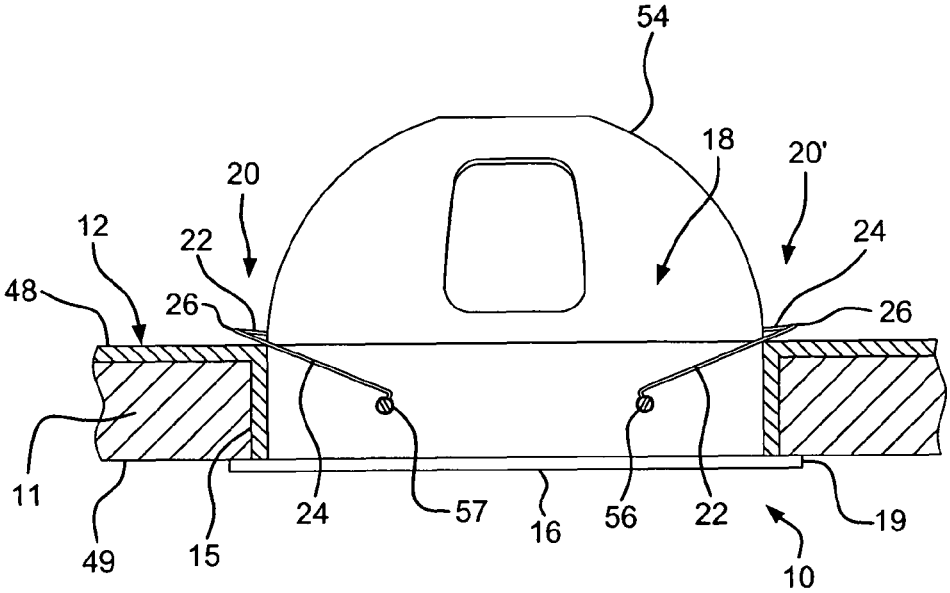
FIG. 1 is a side perspective view of the lighting fixture having a spring clip according to the first embodiment of the invention.
Figure 2:
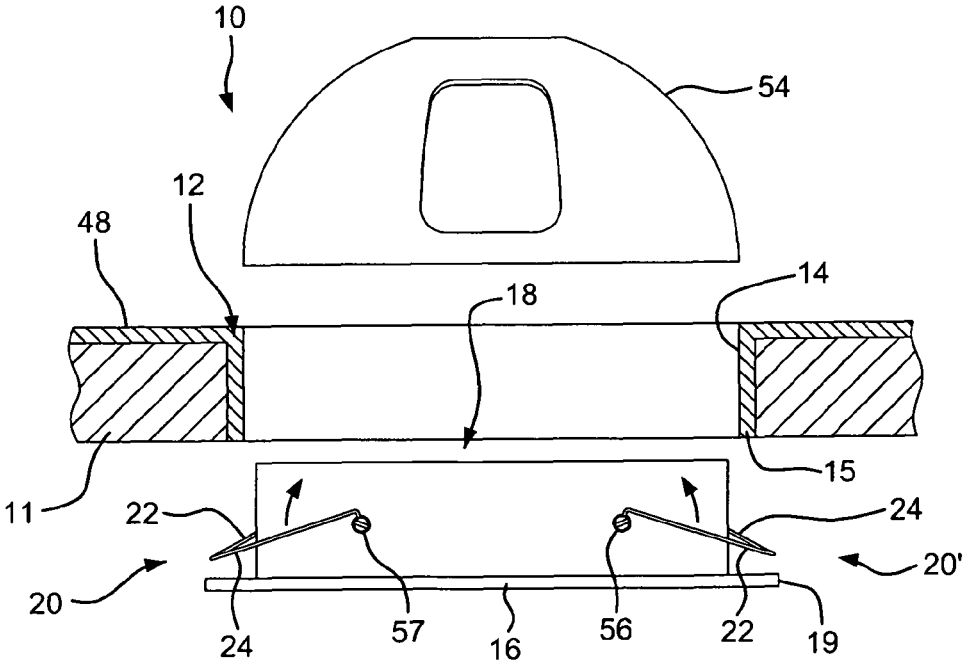
FIG. 2 is an exploded view of the lighting fixture shown in FIG. 1 prior to pivoting the spring clips.
Figure 3:
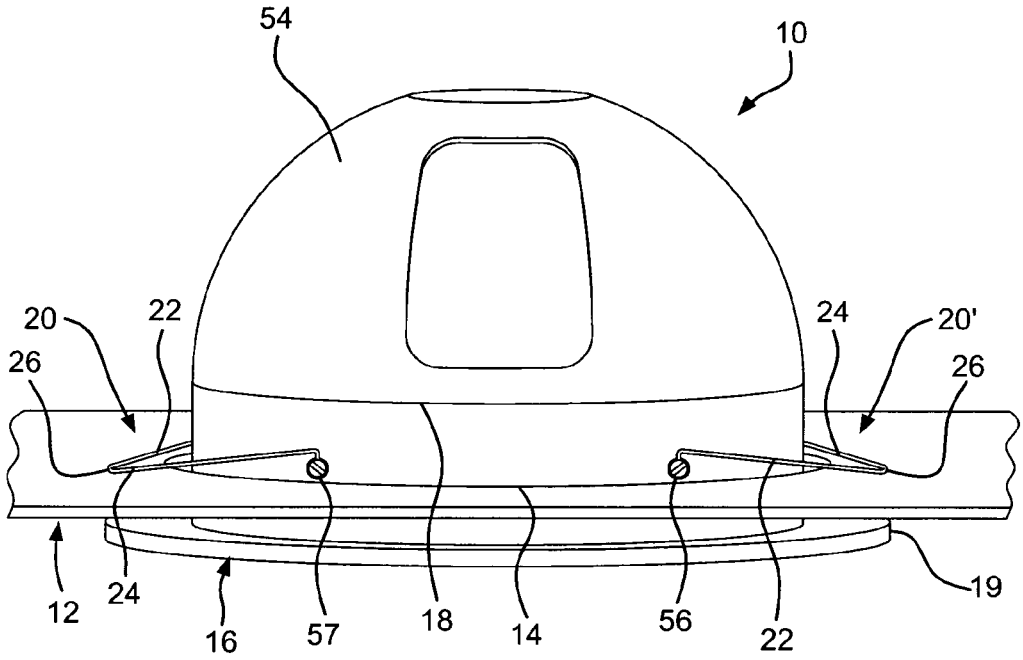
FIG. 3 is a side perspective view of the lighting fixture shown in FIGS. 1 and 2 with the spring clips assembled on the ceiling pan.

The present invention is directed to a lighting fixture and a trim ring installed with a spring retention clip that can be easily assembled to the lighting fixture while providing positive trim retention. The invention is also directed to a lighting fixture and trim ring that can be easily assembled without the use of tools by providing a spring member coupled to the trim for a downward spring force to couple the trim to the lighting fixture.

Turning to the first embodiment illustrated in FIGS. 1-8, a lighting fixture 10 includes a ceiling pan 12 with an opening 14 in a ceiling 11, a top surface 48, and a downwardly extending collar 15 for receiving part of the lighting fixture 10 therein and directing light to a target area. The opening 14 extends between the top surface 48 and bottom surface 49. A trim 16 is received in the opening 14. The trim 16 includes a ring-shaped side wall 18 or trim ring 18 extending upwardly from an outwardly extending flange 19. In the embodiment illustrated, trim 16 is a substantially cylindrical shaped member with cylindrical side wall 18 and flange 19 extending substantially perpendicular to side wall 18. In other embodiments, trim 16 can be non-circular such as a square or rectangular shape. Trim 16 has a shape and dimension to complement opening 14 in ceiling pan 12 so that trim 16 mates neatly and securely within opening 14.

Figure 5:
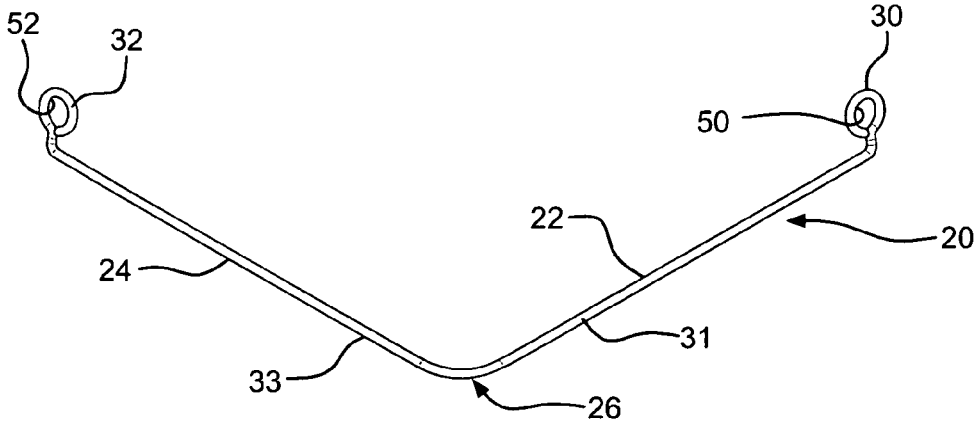
FIG. 5 is a side elevational view of the spring clip shown in FIGS. 1-4.

The trim 16 includes at least one spring clip 20. As seen in FIG. 5, the spring clip 20 has a first leg 22 and a second leg 24 joined at an apex 26 where first leg 22 and second leg 24 are fixed to the side wall 18 of trim 16. The apex 26 is slightly curved such that the angle between the first and second legs 22, 24 is acute. In the embodiment shown, legs 22, 24 are substantially straight and of equal length.

Figure 4:
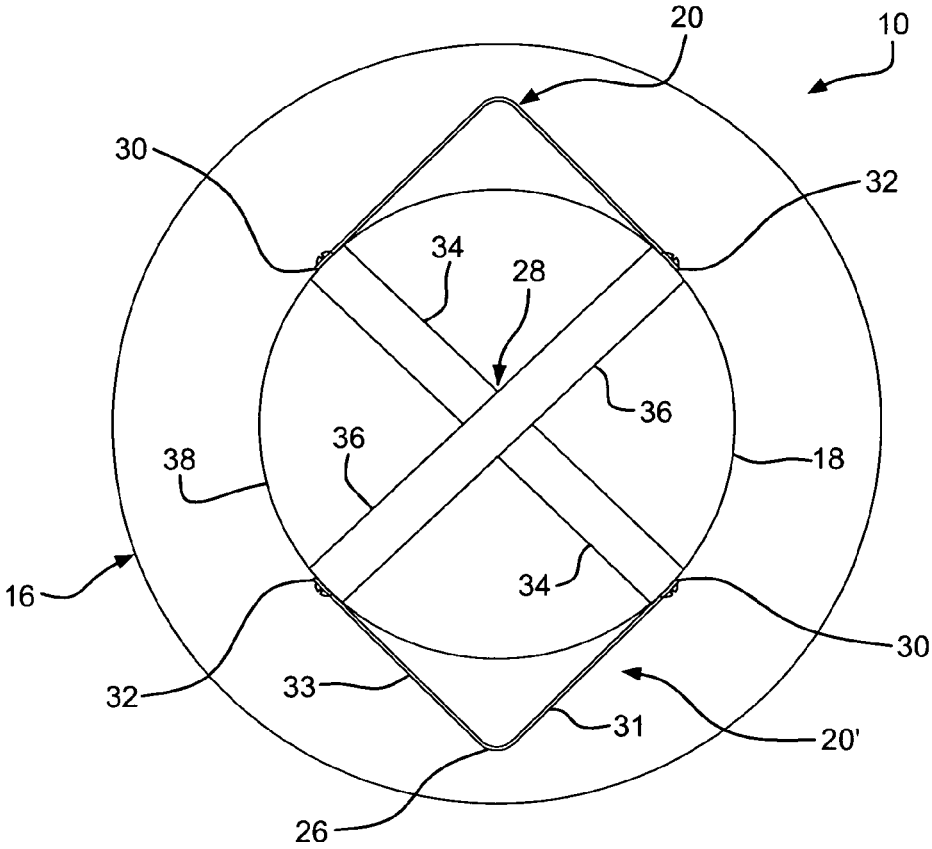
FIG. 4 is a top plan view of the lighting fixture having a spring clip as seen in FIGS. 1-3.
Figure 7:
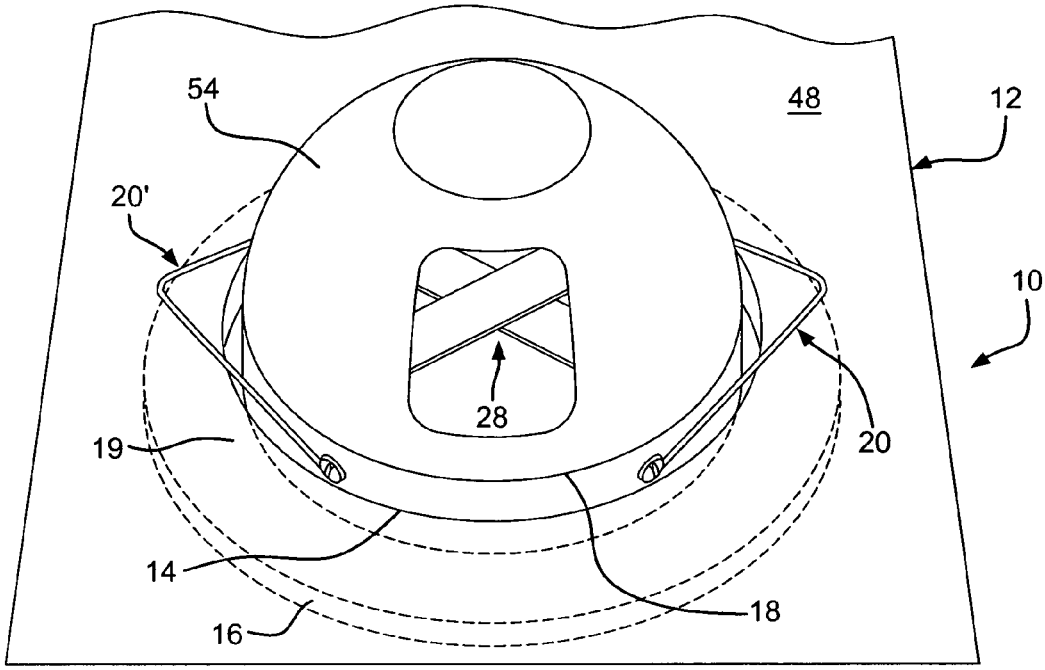
FIG. 7 is a top perspective view of the spring clip shown in FIGS. 1-6 assembled in a ceiling pan.
Figure 8:
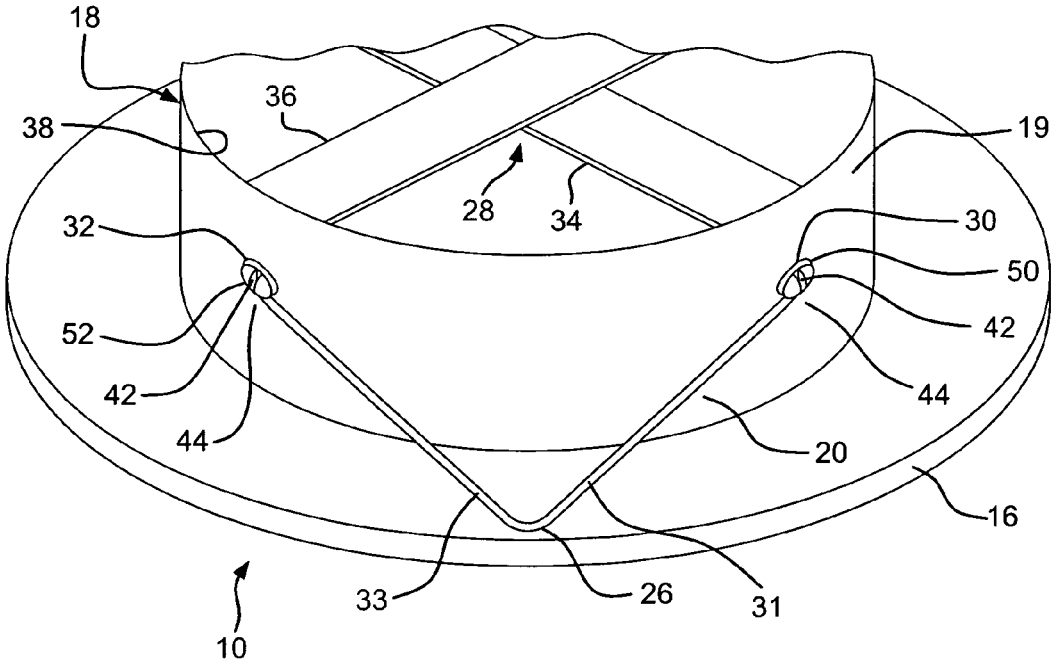
FIG. 8 is a top perspective view of the spring clip shown in FIGS. 1-7.
Figure 9:
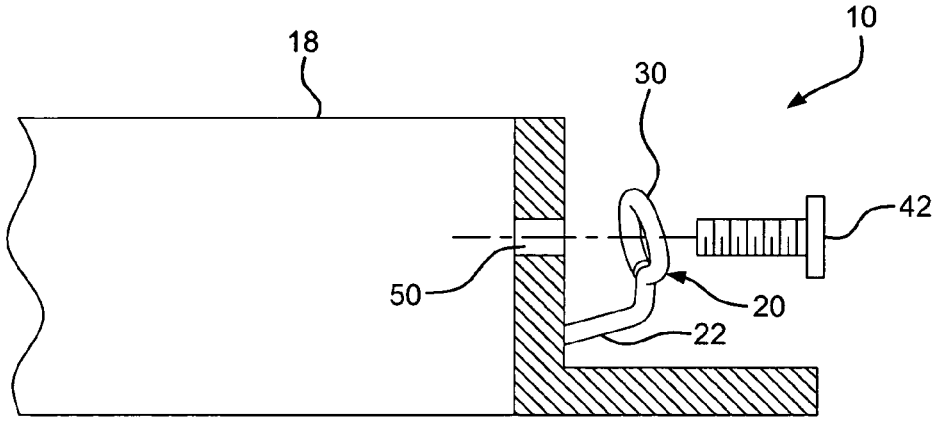
FIG. 9 is a side elevational view of the spring clip shown in FIG. 10 prior to attachment to the trim ring.
Figure 10:
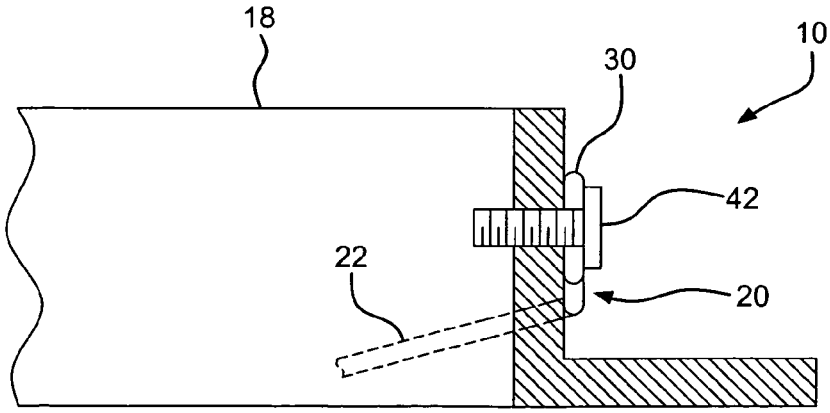
FIG. 10 is a side elevational view of the spring clip according to the first embodiment after attachment to the trim ring.

The legs 22, 24 are angled in a downward direction with respect to the side wall 18 of the trim 16 such that the apex 26 engages a top surface 48 of the ceiling pan 12 when the lighting fixture 10 is installed into an opening 36 in the ceiling pan 12 as shown in FIG. 7. As seen in FIGS. 4 and 5, the first leg 22 has one free end 30 fixed to the trim 16 and the second leg 24 has one free end 32 fixed to the trim 16. Each of the free ends 30, 32 includes a circular-shaped loop having an opening 50, 52, respectively, for receiving a screw 42 which is threaded into a hole in the side wall 18 of the trim 16 for coupling legs 22, 24 to side wall 18. The ends 30, 32 are thus fixed to the trim 16 with screws 42 passing through each of the openings 50, 52, as seen in FIGS. 8-10. The ends 30, 32 can also be fixed to the trim 16 with a rivet or similar mounting method. The legs 20, 22 each have second ends 31, 33 opposite the first free ends 30, 32 that end at the apex 26.

Spring 20 is oriented on side wall 18 to extend toward flange 19 at a bottom end of the trim 16. Screws 42 are tightened to fix the ends 30, 32 of the legs 22, 24 of the spring 20 and prevent rotation or pivotal movement of the ends 30, 32 with respect to the trim 16. The ends 30 being fixed to the side wall of the trim, angled in a downward direction toward flange 19, enables the apex 26 of spring 20 to be biased in a downward direction with respect to the flange 19 and ceiling pan 12 and bias the trim 16 in an upward direction toward the ceiling pan 12 when the apex of the springs engage the top surface 48 of ceiling pan 12. When the screws 42 are tightened to the spring clip 20, the tightening of the screw 42 imparts a force onto the ends 30, 32 of the spring clip 20 which biases the legs 22, 24 of the spring clip 20 in a downward direction, as seen in FIGS. 9 and 10.

Figure 6:
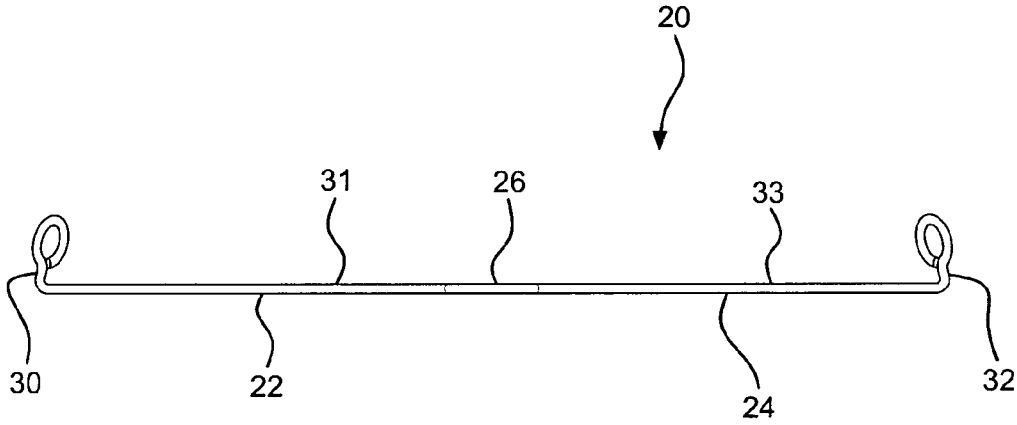
FIG. 6 is a front elevational view of the spring clip shown in FIGS. 1-5.

As shown in FIGS. 5 and 6, the ends 30, 32 and the respective circular loops 50, 52 are angled inwardly with respect to the legs 22, 24. Preferably, the circular loops 50, 52 are formed at an acute angle with respect to the plane of legs 22, 24 and are angled toward each other.

In one embodiment of the invention, the trim 16 includes at least one cross baffle 28. The cross baffle 28 is formed by a first louver 34 and a second louver 36 oriented in a substantially X-shaped configuration disposed across a center 40 of the trim 16. The louvers 34, 36 are substantially rectangular-shaped and extend across the center 40 of the trim 16 and attach to the sides of the side wall 18, as seen in FIG. 4. The cross baffle 28 is adjacent an exposed side of the trim 16. In the embodiment of FIGS. 1-10, the legs 22, 24 of the circular loops 50, 52 of spring clip 20 are aligned with the ends of the baffles 28 for engaging the ceiling pan opening 14.

The trim 16 includes a plurality of attachment points 44 on the outer surface 38 of side wall 18 of the trim 16 for attaching spring clips 20 to trim 16. The circular loops 50, 52 of free ends 30, 32 are attached to the side wall 18 at a respective attachment point 44 on the outer surface 38 of the side wall 18. The circular loops 50, 52 of springs 20 are manually deflected or twisted in a generally upward direction and attached to the side wall 18 by a screw 42 which is threaded into a hole in the side wall 18. The circular loops 50, 52 of spring clip 20 are twisted in a substantially upward direction to apply a twisting or torsional strain to the respective legs 22, 24 when the circular loops 50, 52 are attached to the side wall 18 of the trim 16 by the screw 42. The torsional strain applied to the legs 20, 22 by the twisting motion applied by the screws 42 securing the circular loops 50, 52 to the side wall 18 of the trim 16 assists in providing the downward biasing force toward the flange 19. Preferably, the circular loops 50, 52 are secured to the side wall 18 with legs 20, 22 angled in a downward direction toward the flange 19 to engage the top surface 48 of ceiling pan 12.

The springs 20 are biased downwardly to engage the top surface 48 of the ceiling pan 12, as seen in FIGS. 7 and 8 after the screws 42 are threaded into the side wall 18. Thus, the spring clip 20 engages the top surface 48 of the ceiling pan 12 after entry of the trim 16 into the ceiling pan opening 14 when the spring legs 22, 24 are oriented with respect to side wall 18 to bias in a downward direction.

Assembly and Operation

Preferably, the trim 16 includes two identical springs 20, 20' positioned across from one another along the trim 16, as seen in FIG. 1. Each spring clip 20, 20' is made of flexible and resilient spring material (i.e., spring steel) to allow the spring clip 20 to resume its normal position and positioned in a downward angle to apply a downwardly directed biasing force.

The user inserts one of the springs 20 via the apex 26 into the opening 14 of ceiling pan 12 and pushes the trim 16 into the opening 14 following the same procedure. The apex 26 of the spring clip 20' opposite the initially inserted spring clip 20 is then engaged and the second spring clip 20' is inserted into the opening 14. The user then pushes the rest of the trim 16 into the opening 14 with the reflector 54 positioned above the ceiling pan 12, as seen in FIG. 4. When the trim 16 is installed, the apex 26 of each spring clip 20, 20' is spring biased downwardly, towards the top surface 48 of the ceiling pan 12 and away from the reflector 54.

The spring clip 20 applies a downward force against the ceiling pan 12 and pulls the trim 16 towards the ceiling surface. This installation method also works when the fixture housing 10 is not installed properly. The trim 16 and cross baffle 28 easily rotate within the opening 14 in the ceiling pan 12 after installation. This avoids removing and reassembling of the trim 16, but also allows for tool-less and straightforward removal of the trim 16.

In a second embodiment, illustrated in FIGS. 11-22, a torsion spring clip version of the spring clip 20 in the first embodiment allows a quick retrofit to existing trim rings having cross baffles. Turning to FIGS. 11-13 and 20, a lighting fixture 100 includes a ceiling pan 112 with an opening 114 in a ceiling 111, a top surface 148, and a downwardly extending collar 115. A trim 116 is received in the opening 114 and includes a cylindrical-shaped side wall and an outwardly extending flange 119. Trim 116 is provided with an axial opening for cooperating with the lamp assembly. The trim 116 includes at least one torsion spring clip 120 for coupling the trim 116 with the ceiling pan 112 within the opening 114.

Figure 14:
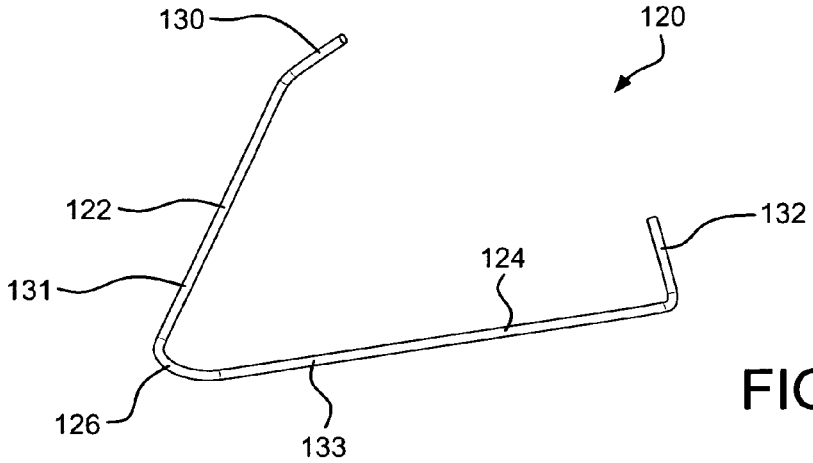
FIG. 14 is a side perspective view of a spring clip according to a second embodiment of the invention.
Figure 15:
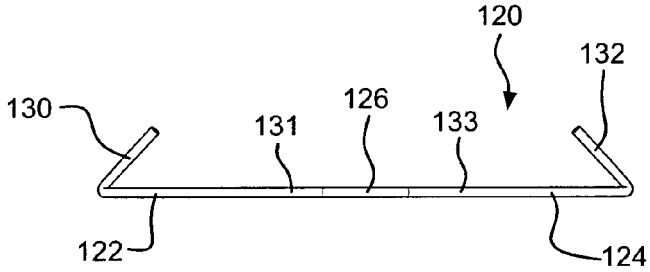
FIG. 15 is a front elevational view of the spring clip shown in FIG. 14.
Figure 16:
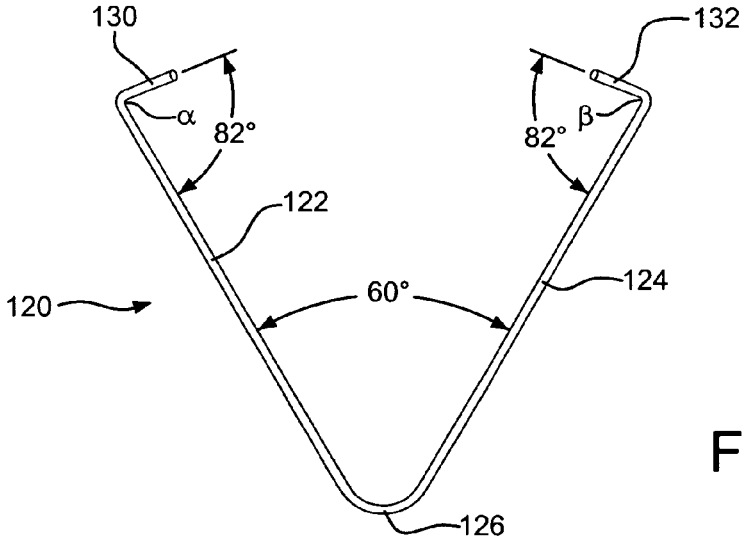
FIG. 16 is a top plan view of the spring clip shown in FIGS. 14 and 15.

As seen in FIG. 14-16, the torsion spring clip 120 includes a first leg 122 and a second leg 124 joined at an apex 126. The torsion spring clip 120 further includes a first end portion 130 extending from first leg 122 and a second end portion 132 extending from second leg 124. End portions 130, 132 extend out of the plane and in a generally upward direction from the plane extending between the legs 122, 124. The legs 122, 124 each have second free ends 131, 133 opposite the first free ends 130, 132 that end at the apex 126. As seen in FIG. 16, the ends 130, 132 are oriented at an acute angle with respect to the legs 122, 124 in a normal position. Preferably, the first leg 122 is oriented at an acute angle with respect to the longitudinal dimension of second leg 124. In one exemplary embodiment shown in FIG. 16, the first and second legs 122, 124 are disposed at substantially a 60° angle.

Turning to FIG. 16, even though the first angle $\alpha$ and second angle $\beta$ are substantially equivalent, the displacement of the first free end 130 with respect to the first leg 122 is oriented in a direction opposite the displacement of the second free end 132 with respect to the second leg 124. Angle $\alpha$ is the angle between free end 130 and leg 122. Angle $\beta$ is the angle between free end 132 and leg 124. In other words, the first free end 130 is oriented at a first angle $\alpha$ with the first leg 122 and the second free end 132 is oriented at a second angle $\beta$ with the second leg 124, in a direction opposite that of the first angle $\alpha$. In one embodiment shown in FIG. 16, both the first angle $\alpha$ and the second angle $\beta$ are acute angles, approximately equal to 82° from the leg 122, 124, respectively. This configuration provides the downward biasing force to the first and second legs 122, 124 to engage the top surface 148 when ends 130 and 132 are attached to trim 116 that biases the spring and pulls the trim 116 into the ceiling pan, orienting the trim 116 with bottom edge of collar 115 of ceiling pan 112.

As best seen in FIG. 14, the torsion spring clip 120 is characterized by the opposite angular orientation of the first free end 130 with respect to the first leg 122 and the second free end 132 with respect to the second free leg 124. The ends 130, 132 of the torsion spring clip 120 are angled with respect to the legs 122, 124 so that when the ends are inserted into a respective bearing in side wall 118 (or trim ring 118) twist the legs 122, 124 of spring clip 120, providing a downward spring force such that the trim 116 is pulled into the opening of the ceiling pan 114 and is flush with the bottom edge of collar 115 of the ceiling pan 112. More specifically, when the ends 130, 132 are inserted into the trim 116, the force of the bore 158, 157 against the ends 130, 132 causes the ends 130, 132 to align substantially perpendicular to the central axis of side wall 116, thus creating a torsional force such that the legs 122, 124 are biased in a generally downward direction. With this configuration, each of the first and second legs 122, 124 extend substantially tangentially from the trim 116.

In this embodiment, trim 116 includes a plurality of bearings 156 positioned to receive the ends 130, 132 of spring clip 120. Each bearing 156 is coplanar and extends substantially perpendicular to the central axis of the trim 116 and substantially perpendicular to side wall 118. The bearing has an axial bore 158 with a diameter to receive the respective end 130, 132 of spring 120 and an axial length to receiving the respective end 130, 132 of spring 120 and an axial length to receive the respective end 130, 132 and retain the end 130, 132 in axial alignment with the bore 158. As shown in FIGS. 14-16, ends 130, 132 are angled with respect to each other and are not coaxially aligned when spring 120 is in the relaxed normal position. Spring 120 is coupled to the side wall 118 by inserting the respective end 130, 132 into the bore 158 of the respective bearing 156. To insert the ends 130, 132 into the bore 158 of the bearing 156, it is necessary to twist or flex the ends in a rotational direction with respect to the longitudinal axis of legs 122, 124, thereby applying a torsional strain on legs 122, 124. Bearings 156 have a dimension to retain ends 130, 132 in the twisted orientation so that the ends 130, 132 lie in substantially the same plane which is preferably substantially perpendicular to the central axis of side wall 118.

Figure 17:
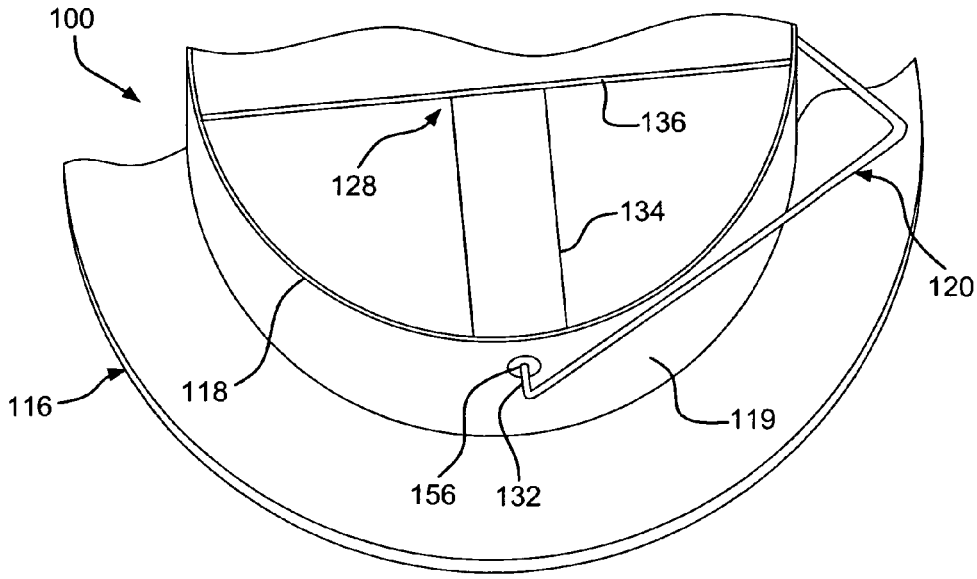
FIG. 17 is a top perspective view of the spring clip shown in FIGS. 14-16 assembled in a lighting fixture engaging a first cross baffle.
Figure 18:
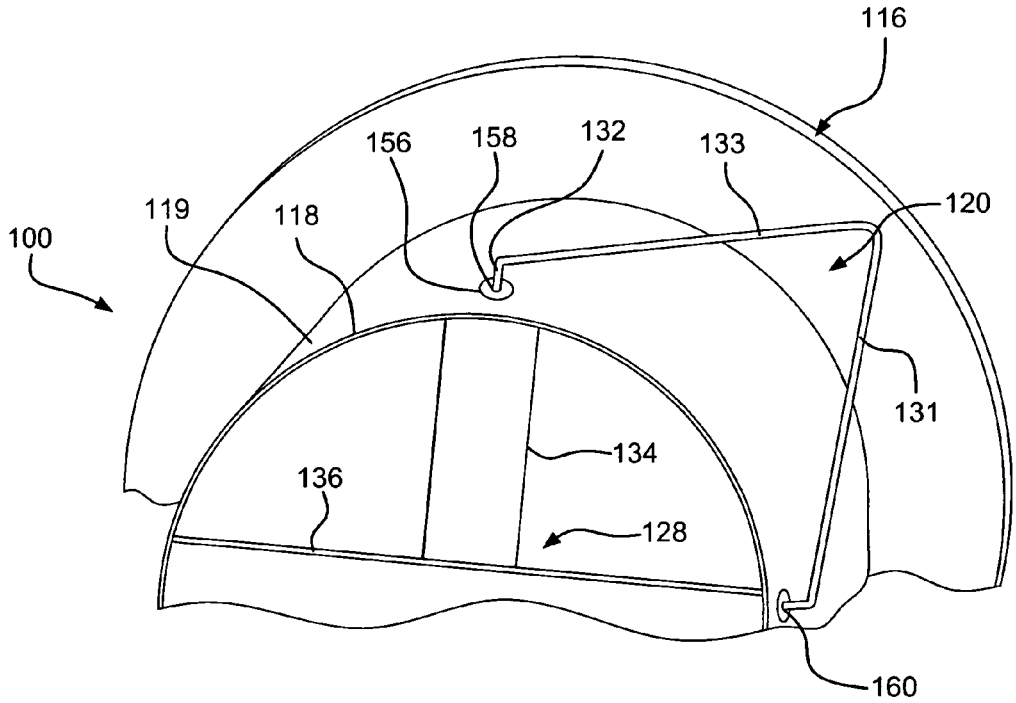
FIG. 18 is a top perspective view of the lighting fixture shown in FIG. 17 with the spring clip shown in FIGS. 14-17 engaging a second cross baffle.
Figure 19:
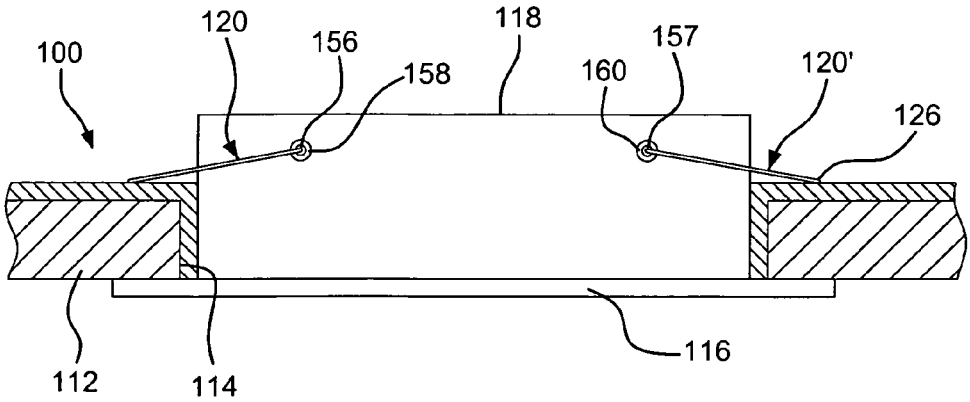
FIG. 19 is a side perspective view of the lighting fixture shown in FIGS. 17 and 18 assembled in a ceiling pan.

In the embodiment illustrated, two springs 120 are provided and positioned on opposite sides of side wall 118. In this embodiment, four bearings 156 are provided that are spaced about 90° apart around the circumference of side wall 118. As shown in FIGS. 17 and 18, ends 130, 132 of a respective spring 120 when received in the bearing are oriented at about 90° to each other.

Figure 21:
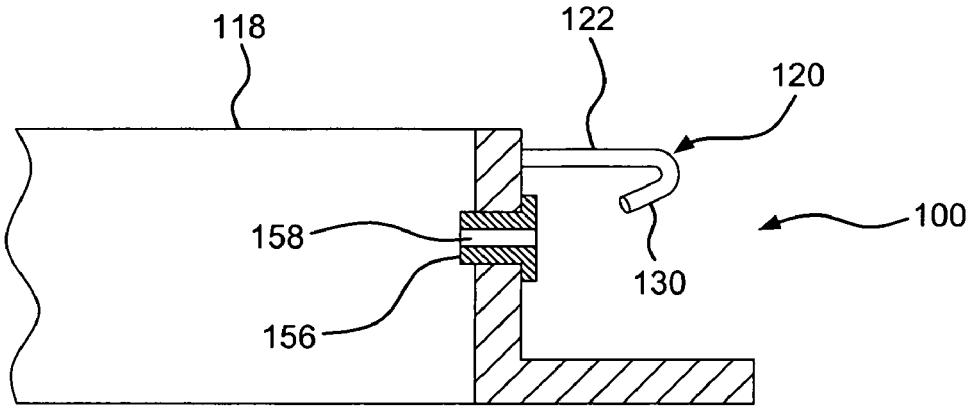
FIG. 21 is a side elevational view of the spring clip shown in FIG. 22 prior to attachment to the trim ring.
Figure 22:
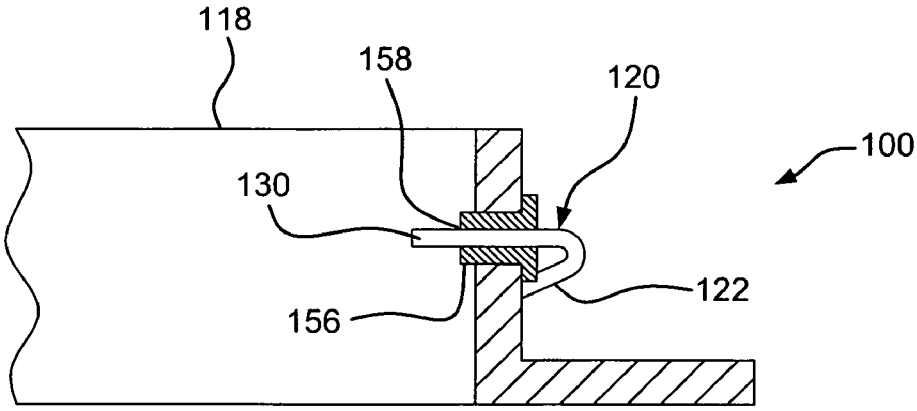
FIG. 22 is a side elevational view of the spring clip according to the second embodiment after attachment to the trim ring.

As illustrated in FIGS. 21 and 22, when a free end 130 is inserted into a bearing 156, the restriction of the free end 130 imparts a downward force onto the spring leg 122 biasing the spring leg 122 in a downward direction with respect to the ceiling pan 112 and bias the trim 116 in an upward direction toward the ceiling pan 112. Similarly, when free end 132 is inserted into bearing 157, the restriction of the free end 132 imparts a downward force onto the spring leg 124 biasing the spring leg 124 in a downward direction with respect to the ceiling pan 112 and bias the trim 116 in an upward direction toward the ceiling pan 112. This allows the springs 120, 120' to fix the trim 116 to the ceiling panel 112.

In one embodiment, the torsion spring clip 120 allows quick retrofit to existing trim rings 118 having rivets with an axial bore such as that used to attach cross baffles 128 to the side wall 118. Turning to FIGS. 17 and 18, to retrofit the torsion spring clip 120 to an assembled riveted cross baffle 128, one of the ends 130, 132 is mounted in the bore 158 of a rivet 156 used to attach to a louver 134 to the trim 16. Additional mounting methods can be used including an extruded hole, alternative bearing, or two coaxially aligned bores disposed in sheet metal pieces.

Figure 20:
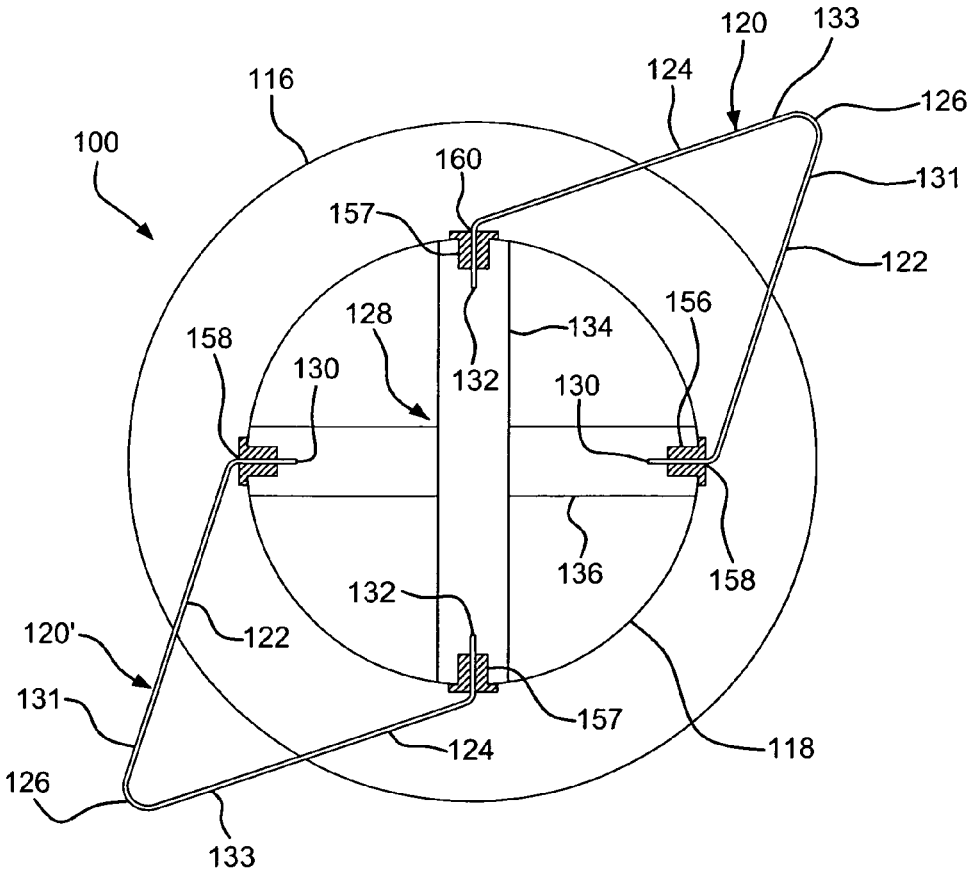
FIG. 20 is a top plan view of the spring clip shown in FIGS. 15-19 engaging first and second cross baffles.

With this configuration, the bore 158 rivet 156 is used as a pivot bearing for the end portion 130 of the torsion spring clip 120. The end 132 is also mounted in a second bore 160 of a second rivet 157 adjacent to a louver 136 opposite the first louver 134. As seen in FIG. 20, a torsion spring clip 120 is installed between the intersection of two louvers 134, 136 and an additional torsion spring clip 120' is installed between the intersection of the two louvers 134, 136 at the opposite end of the trim ring 118 where the first torsion spring clip 120 is installed.

Figure 11:
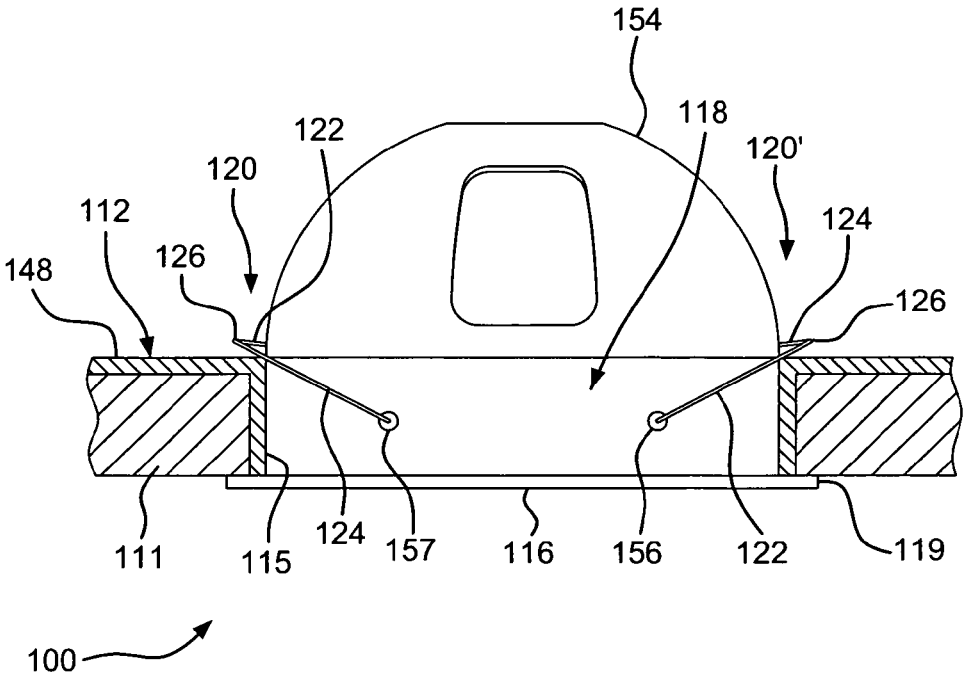
FIG. 11 is a side perspective view of the lighting fixture having a spring clip according to the second embodiment of the invention.
Figure 12:
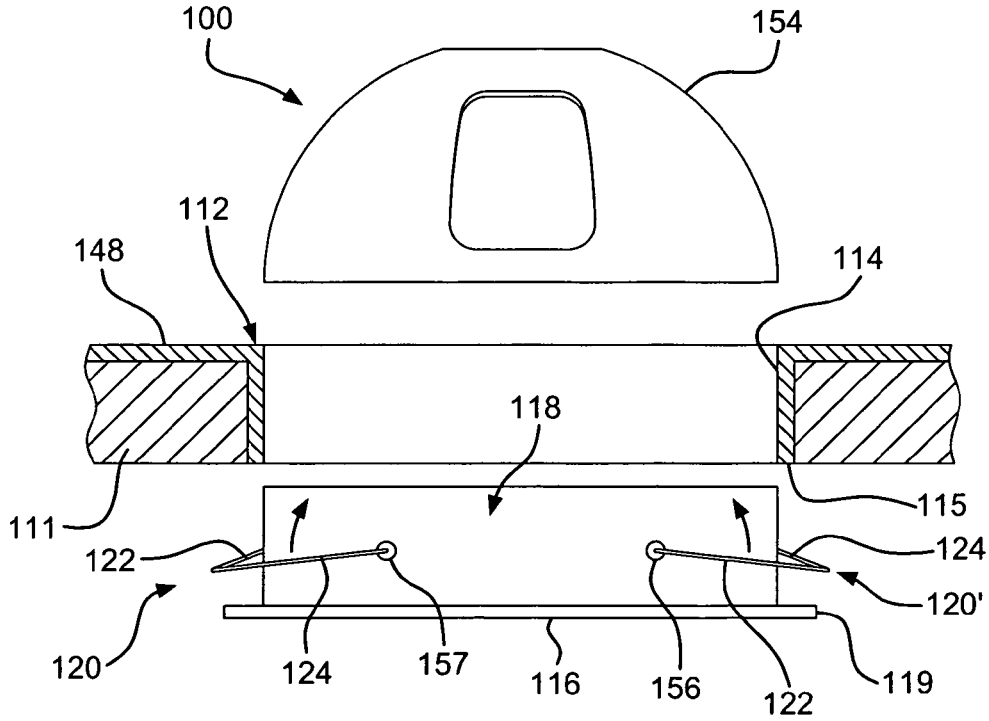
FIG. 12 is an exploded view of the lighting fixture shown in FIG. 11 prior to pivoting the spring clips.
Figure 13:
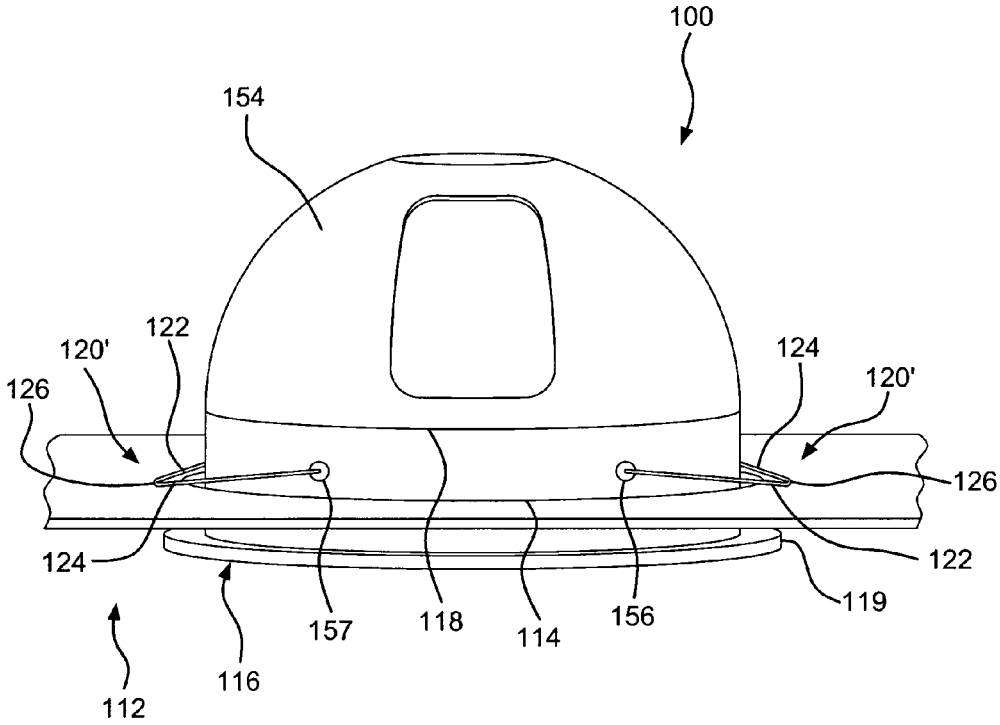
FIG. 13 is a side perspective view of the lighting fixture shown in FIGS. 11 and 12 with the spring clips assembled on the ceiling pan.

The trim 116 preferably includes two identical torsion spring clips 120, 120' positioned across from one another along the trim ring 118, as seen in FIGS. 11-13. Each torsion spring clip 120, 120' is made of flexible and resilient spring material such that each torsion spring clip 120, 120' can be deflected away from the trim ring 118 and then resume its original position and are biased at a downward angle after the trim 116 is received in the ceiling pan opening 114.

Similar to the operation of the spring clip 20 of the first embodiment, when the trim 116 is inserted into the opening 114, a user engages the apex 126 of the torsion spring clip 120 and pulls it upwardly, away from the ring 118 and towards the ceiling pan 112, as seen in FIG. 11. The user inserts one of the torsion spring clips 120 via the apex 126 into the opening 114 and pushes the trim 116 into the opening 114. The apex 126 of the torsion spring clip 120' opposite the first inserted torsion spring clip 120 is then engaged and the second torsion spring clip 120' is inserted into the opening 114. Next, the user pushes the rest of the trim 116 through the opening 114 with the reflector 154 positioned above the ceiling pan 112, seen in FIG. 19. When the trim 116 is installed, the apex 126 of each torsion spring clip 120 is spring biased downwardly, towards the trim ring 118 and away from the reflector (not shown).

The ends 130, 132 of the torsion spring clips 120, 120' are angled with respect to the legs 122, 124 to twist the torsion spring clips 120, 120', providing a downward spring force such that the trim 116 is pulled into the ceiling pan 112 and is flush with the ceiling surface. This installation method allows for a quick retrofit to existing trim rings 118 having cross baffles 128 because the torsion spring clip 120 is mounted in the bore 158 of an existing rivet 156 using the tubular section of the rivet body as a pivot bearing.

Once the trim, associated with both the first and second embodiments of the spring clips, is installed, and the springs are flexed to apply a downward force, the trim is easily rotated to align a baffle.

While a particular embodiment has been chosen to illustrate the invention, it will be understood by those skilled in the art that various changes and modifications can be made therein without departing from the scope of the invention as defined in the appended claims.

What is claimed is:

1. A lighting fixture comprising:

a pan having an opening and being adapted for mating with a ceiling panel;

a trim member received in said opening; and a spring clip having first and second legs, each leg having a first end portion coupled to said trim member and a second end joined together at an apex, said end portions of said spring clip extending inwardly with respect to each other and at an incline with respect to a plane of said first and second legs, said end portions being coupled to said trim member to bias said apex of said spring clip in a downward direction with respect to said pan whereby said apex engages a top surface of said pan to couple said trim member to said pan.

2. The lighting fixture according to claim 1 wherein said first end portion of each of said legs is fixed to said trim member with a screw.

3. The lighting fixture according to claim 2 wherein said first end portion includes a circular-shaped member receiving the screw for fixing said first end to said trim member.

4. The lighting fixture according to claim 1 wherein each of said legs is angled in a downward direction toward a bottom end of said trim member.

5. The lighting fixture according to claim 1 wherein said trim member further includes a plurality of attachment points adapted to secure a plurality of spring clips to an outer surface of said trim member.

6. The lighting fixture according to claim 1 wherein said spring clip is made of spring steel.

7. The lighting fixture of claim 1 wherein said end portions of said legs are coupled to said trim member to fix said end portions in a horizontal plane with respect to said pan to bias said apex in said downward direction.

8. The lighting fixture of claim 7 wherein said trim ring includes two apertures receiving a respective end portion of said first and second legs, said apertures extending in an axial direction substantially parallel to a plane of said pan and adapted for retaining said end portions under tension in a plane substantially parallel to said pan.

9. The lighting fixture of claim 8 wherein said trim member includes two spaced apart rivets having an axial bore defining said apertures.

10. The lighting fixture of claim 1 wherein said trim member defining an annular side wall oriented substantially perpendicular to said ceiling panel, and said end portions of said legs being coupled to an outer surface of said annular side wall to tension said end portions in a direction to bias said legs in said downward direction.

11. A lighting fixture comprising:

a pan having a top surface and an opening with a downwardly extending collar surrounding said opening for directing light to a target area;

a trim ring received in said collar, said trim ring having an annular side wall complementing said collar;

a torsion spring clip coupled to said side wall, said spring clip having first and second legs coupled together at a first end to form an apex and a second end portion extending from a second end of said first and second legs, respectively, wherein said end portions are oriented at an inclined angle with respect to a plane of said first and second legs in a normal rest position and extend inwardly with respect to said legs and at an inclined angle with respect to each other, said end portions being coupled to said trim ring under tension to form a downward biasing force to said first and second legs to engage said top surface of said pan to retain said trim ring in said opening.

12. The lighting fixture according to claim 11 wherein said trim ring includes at least one cross baffle.

13. The lighting fixture according to claim 12 wherein said side wall of said trim ring includes a rivet having a bore.

14. The lighting fixture according to claim 13 wherein said end portions of said first and second legs of said torsion spring clip are mounted in a bore of a respective rivet substantially parallel to each other.

15. The lighting fixture according to claim 11 wherein said end portions of said first and second legs of said torsion spring clip are mounted into a respective body of said trim ring, each said body having an axial bore extending substantially parallel to a plane of said pan whereby said end portions are held under tension to form said biasing force to bias said apex in a downward direction.

16. The lighting fixture of claim 11 wherein said end portions of said legs are coupled to said annular side wall of said trim ring to extend in a plane substantially parallel to said top surface of said pan under tension to bias said legs in said downward direction.

17. The lighting fixture of claim 16 wherein said annular wall of said trim ring has two apertures extending therethrough, and where said end portions of said spring clip are received in a respective aperture under tension to retain said end portions substantially perpendicular to a plane of said side wall.

18. The lighting fixture of claim 17 wherein said side wall has a rivet extending through each of said apertures and having an axial bore receiving said end portions.

19. A lighting fixture comprising:

a pan having a top surface, a bottom surface and an opening extending between said top surface and bottom surface, said pan adapted for mating with a ceiling panel and for supporting a lighting assembly;

a trim member having a side wall with a dimension for being received in said opening in said pan and an outwardly extending flange at a bottom edge of said side wall, said side wall having a plurality of supports having an axial passage extending through said side wall; and at least two spring members coupled to said supports of said trim member for coupling said trim member to said pan;

each said spring member having a first leg with a first end portion and a second leg having a first end portion, said first and second legs having a second end joined together at an apex, said end portions extending inwardly with respect to each other and at an incline with respect to a plane of said first and second legs, each said end portion being received in a respective axial bore under tension to lie in a plane substantially perpendicular to said side wall of said trim ring to form a biasing force to bias said legs in a downward direction whereby said second ends engage said top surface of said pan and couple said trim member to said pan.

20. The lighting fixture according to claim 19 wherein the first and second supports are coplanar.

21. The lighting fixture according to claim 19 wherein each of said first and second legs extend substantially tangentially from said trim member.

22. The lighting fixture of claim 19 wherein said trim member includes a plurality of rivets extending through said side wall, said rivets having an axial bore defining said supports.

23. The lighting fixture of claim 22 wherein said trim member includes a plurality of baffles secured to said side wall by said rivets.

* * * * *